US009944107B2

(12) United States Patent
Tanaka et al.

(10) Patent No.: US 9,944,107 B2
(45) Date of Patent: Apr. 17, 2018

(54) RECORDING MEDIUM

(71) Applicant: CANON KABUSHIKI KAISHA, Tokyo (JP)

(72) Inventors: Takatoshi Tanaka, Tokyo (JP); Yasuhiro Nito, Inagi (JP); Tetsufumi Shiba, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/384,392

(22) Filed: Dec. 20, 2016

(65) Prior Publication Data

US 2017/0197450 A1 Jul. 13, 2017

(30) Foreign Application Priority Data

Jan. 8, 2016 (JP) ..... 2016-002756

(51) Int. Cl.
*B41M 5/00* (2006.01)
*B41M 5/52* (2006.01)
*B41M 5/50* (2006.01)

(52) U.S. Cl.
CPC ..... *B41M 5/5218* (2013.01); *B41M 5/502* (2013.01); *B41M 5/5254* (2013.01)

(58) Field of Classification Search
CPC ... B41M 5/502; B41M 5/5218; B41M 5/5227
See application file for complete search history.

(56) References Cited

U.S. PATENT DOCUMENTS

| | | | | |
|---|---|---|---|---|
| 6,874,881 | B2 | 4/2005 | Suzuki et al. | |
| 6,929,362 | B2 | 8/2005 | Takada et al. | |
| 6,932,465 | B2 | 8/2005 | Nito et al. | |
| 6,935,732 | B2 | 8/2005 | Takada et al. | |
| 7,029,109 | B2 | 4/2006 | Shirota et al. | |
| 7,055,943 | B2 | 6/2006 | Suzuki et al. | |
| 7,208,032 | B2 | 4/2007 | Hakamada et al. | |
| 7,276,110 | B2 | 10/2007 | Tsujimura et al. | |
| 7,276,112 | B2 | 10/2007 | Tokuda et al. | |
| 7,347,890 | B2 | 3/2008 | Nito et al. | |
| 7,354,145 | B2 | 4/2008 | Nito et al. | |
| 7,377,631 | B2 | 5/2008 | Takada et al. | |
| 7,402,200 | B2 | 7/2008 | Imai et al. | |
| 7,517,073 | B2 | 4/2009 | Nito et al. | |
| 7,517,074 | B2 | 4/2009 | Hakamada et al. | |
| 7,537,329 | B2 | 5/2009 | Nito et al. | |
| 7,635,182 | B2 | 12/2009 | Hakamada et al. | |
| 8,016,406 | B2 | 9/2011 | Hakamada et al. | |
| 8,080,291 | B2 | 12/2011 | Tanaka et al. | |
| 8,236,394 | B2 | 8/2012 | Tanaka et al. | |
| 8,247,042 | B2 | 8/2012 | Asakawa et al. | |
| 8,247,043 | B2 | 8/2012 | Tanaka et al. | |
| 8,252,392 | B2 | 8/2012 | Oguri et al. | |
| 8,486,499 | B2 | 7/2013 | Nito et al. | |
| 8,524,336 | B2 | 9/2013 | Oguri et al. | |
| 8,545,008 | B2 | 10/2013 | Asao et al. | |
| 8,609,209 | B2 | 12/2013 | Taguri et al. | |
| 8,795,798 | B2 | 8/2014 | Oguri et al. | |
| 8,846,166 | B2 | 9/2014 | Herlambang et al. | |
| 9,090,789 | B2 | 7/2015 | Hakamada et al. | |
| 9,302,525 | B2 | 4/2016 | Oguri et al. | |
| 9,511,612 | B2 | 12/2016 | Noguchi et al. | |
| 2002/0071018 | A1* | 6/2002 | Tachikawa | B41M 5/52 347/106 |
| 2002/0182379 | A1* | 12/2002 | Schade | B41M 5/52 428/32.34 |
| 2004/0121092 | A1* | 6/2004 | Laney | B41M 5/506 428/32.1 |
| 2016/0271986 | A1* | 9/2016 | Nagase | B41M 5/502 |

FOREIGN PATENT DOCUMENTS

| | | | | |
|---|---|---|---|---|
| JP | S58-193185 A | | 11/1983 | |
| JP | 2003-094794 A | | 4/2003 | |
| JP | 2004-268377 A | * | 9/2004 | B41M 5/00 |
| JP | 2005-153221 A | | 6/2005 | |
| JP | 2006-116797 A | | 5/2006 | |

OTHER PUBLICATIONS

Jun. 30, 2017 European Search Report in European Patent Appln. No. 16002745.4.

* cited by examiner

*Primary Examiner* — Betelhem Shewareged
(74) *Attorney, Agent, or Firm* — Fitzpatrick, Cella, Harper & Scinto

(57) ABSTRACT

An inkjet recording medium including a substrate and an ink receiving layer on the substrate, wherein the ink receiving layer includes amorphous silica having an average secondary particle size of 3 μm or more, and a binder, the peak area ratio (C1s/Si2p) of a carbon atom (C1s) to a silicon atom (Si2p) in measurement of the surface of the ink receiving layer by X-ray photoelectron spectroscopy is 0.7 or more and 2.3 or less, and the contact angle between the surface of the ink receiving layer and pure water after a lapse of 10 ms from contact of the surface of the ink receiving layer with 4 μl of pure water is 60° or less.

7 Claims, No Drawings

RECORDING MEDIUM

BACKGROUND OF THE INVENTION

Field of the Invention

The present invention relates to a recording medium.

Description of the Related Art

A low-glossy recording medium having matted surface quality with subdued and deep hue is demanded for use in an inkjet recording method and the like. To provide such a recording medium, generally a pigment particle having a large secondary particle size is contained in the surface layer of a recording medium to thereby decrease the degree of gloss of the recording medium. In recent years, an art-style and high-quality image has been increasingly demanded to be printed on such a matted recording medium by use of an aqueous pigment ink. In order to satisfy such a demand, an increase in optical density of an image has been demanded.

In view of the demands, Japanese Patent Application Laid-Open No. 2006-116797 discloses a recording medium including one or more ink receiving layers on a support. In the recording medium, an ink receiving layer as the outermost layer contains at least porous synthetic amorphous silica having an average particle size of 2.9 μm or less and a BET specific surface area of 260 $m^2/g$ or less, and an adhesive. Such a configuration enables color development property of a pigment ink to be enhanced. Japanese Patent Application Laid-Open No. 2005-153221 discloses an inkjet recording sheet provided with a coating layer containing a pigment, an adhesive and an ink fixing agent, on a support, wherein the coating layer contains a surfactant and the contact angle after 0.5 seconds from contact of the surface of the coating layer with distilled water is adjusted to 10 to 30°. Such a configuration enables image uniformity and water resistance to be enhanced.

SUMMARY OF THE INVENTION

An object of the present invention is to provide a recording medium having a matted surface quality, which enables the optical density of an image to be achieved at a high level in printing by use of an aqueous pigment ink.

One aspect of the present invention provides an inkjet recording medium including a substrate and an ink receiving layer on the substrate, wherein the ink receiving layer includes amorphous silica having an average secondary particle size of 3 μm or more, and a binder, a peak area ratio (C1s/Si2p) of a carbon atom (C1s) to a silicon atom (Si2p) in measurement of a surface of the ink receiving layer by X-ray photoelectron spectroscopy is 0.7 or more and 2.3 or less, and a contact angle between the surface of the ink receiving layer and pure water after a lapse of 10 ms from contact of the surface of the ink receiving layer with 4 μl of pure water is 60° or less.

Further features of the present invention will become apparent from the following description of exemplary embodiments.

DESCRIPTION OF THE EMBODIMENTS

Preferred embodiments of the present invention will now be described in detail.

The present inventors have made studies about the invention recited in Japanese Patent Application Laid-Open No. 2006-116797, and have found that, while the optical density of an image can be achieved at a certain level in printing by use of an aqueous pigment ink, the optical density of an image is not achieved at a higher optical density demanded by the present inventors.

The present inventors have made studies about the invention recited in Japanese Patent Application Laid-Open No. 2005-153221, and have found that, while the optical density of an image can be achieved at a certain level in printing by use of an aqueous pigment ink, the optical density of an image is not achieved at a higher level demanded by the present inventors.

The present inventors made intensive studies in order to provide a recording medium having a matted surface quality, which enables the optical density of an image to be achieved at a high level in printing by use of an aqueous pigment ink, and completed the present invention.

Hereinafter, the present invention is described in detail with reference to suitable embodiments.

The recording medium of the present invention includes an ink receiving layer containing amorphous silica and a binder, on a substrate. In the present invention, the peak area ratio (C1s/Si2p) of a carbon atom is electron (C1s) to a silicon atom 2p electron (Si2p) in measurement of the surface of the ink receiving layer by X-ray photoelectron spectroscopy satisfies 0.7 or more and 2.3 or less.

X-ray photoelectron spectroscopy is a method where an element is irradiated with an X-ray and the kinetic energy unique to a free electron emitted from the element is qualitatively and quantitatively measured. In X-ray photoelectron spectroscopy, a constituent element present within a depth range of about 5 nm from the surface of the ink receiving layer is subjected to measurement in terms of properties of the measurement principle. In the X-ray photoelectron spectroscopic spectrum obtained by X-ray photoelectron spectroscopy, the peak of a carbon atom (C1s) mainly originates from a carbon atom of the binder and the peak of a silicon atom (Si2p) mainly originates from a silicon atom of the amorphous silica. Accordingly, the peak area ratio (C1s/Si2p) of a carbon atom (C1s) to a silicon atom (Si2p) in measurement of the surface of the ink receiving layer by X-ray photoelectron spectroscopy can be mainly used for an index of the ratio between the binder and the amorphous silica present in the surface of the ink receiving layer.

The peak area ratio (C1s/Si2p) can be within the above range to thereby allow a pigment ink to be sufficiently fixed onto the surface of the amorphous silica and allow high color development property in pigment ink printing to be imparted.

On the other hand, a peak area ratio (C1s/Si2p) of less than 0.7 means a low rate of the binder present in the surface of the ink receiving layer. Therefore, binding by the binder in the surface is insufficient to thereby cause minute cracks to be generated on the surface of the ink receiving layer. As a result, surface scattering due to such minute cracks causes color development property in pigment ink printing to be deteriorated.

A peak area ratio (C1s/Si2p) of more than 2.3 means a high rate of the binder present in the surface of the ink receiving layer. Therefore, when printing is performed by a pigment ink, rapid absorption of a solvent included in the pigment ink into the ink receiving layer hardly occurs. In addition, the binder, to which the pigment ink is less likely fixed than the amorphous silica, is more present in the surface of the ink receiving layer, and therefore fixability of the pigment ink onto the surface of the ink receiving layer is also deteriorated. From such reasons, color development property in pigment ink printing is considered to be deteriorated.

The peak area ratio (C1s/Si2p) is more preferably, 0.7 or more and 2.0 or less, further preferably 1.0 or more and 1.7 or less.

The peak area ratio is largely affected by the content ratio between the amorphous silica and the binder, but is not necessarily determined by only the content ratio. The peak area ratio is also affected by the dry state after coating with a coating liquid for ink receiving layer formation. That is, when drying is performed at a high temperature or at a high air speed condition at the initial stage thereof in a drying process during formation of the ink receiving layer, water in the coating liquid for ink receiving layer formation is rapidly evaporated. Such rapid evaporation may also cause the binder to be easily more present in the vicinity of the surface of the ink receiving layer, resulting in an increase in the relative amount of the binder to the amorphous silica in the surface of the ink receiving layer. In the present invention, drying can be then performed at a low temperature (low-temperature drying, or the start of drying being delayed) or at a low air speed condition at the initial stage thereof in a drying process after coating of the substrate with an ink receiving layer coating liquid, resulting in suppression of rapid evaporation of water. Such a drying process can allow the amount of the binder present in the surface of the ink receiving layer to be adjusted, resulting in adjustment of the peak area ratio.

The ratio can also be adjusted even in post-treatment after production of the ink receiving layer. Examples of the post-treatment include coating with a hydroxide of an alkali metal or an alkali earth metal. The coating can be performed in an amount of coating after drying of $0.05/m^2$ or more and $1\ g/m^2$ or less.

In the present invention, the contact angle after a lapse of 10 ms from contact of the surface of the ink receiving layer with 4 μl of pure water satisfies 60° or less.

The value of the contact angle is measured as follows. 4 μl of pure water is dropped on the surface of the ink receiving layer in an environment of 23° C. and 50% RH by use of a dynamic absorption tester (DAT) 1100 manufactured by Fibro Systems AB. After such dropping, the contact angle after a lapse of 10 ms (milliseconds) is then measured. In the present invention, the ink receiving layer is an outermost surface layer of the recording medium. The contact angle between the surface of the ink receiving layer and pure water means a contact angle between the surface of the recording medium and pure water.

In the present invention, when the contact angle after 10 ms is 60° or less, the pigment ink can be promptly wet-spread on the surface of the amorphous silica after landed on the ink receiving layer. Therefore, the pigment ink can be uniformly fixed onto the surface of the amorphous silica, and high color development property in pigment ink printing can be thus imparted. The contact angle is preferably 52° or less, further preferably 49° or less. It is important for color development property in printing by use of the pigment ink that the ink be promptly wet-spread in a very short time of 10 ms after landing of the ink, as in the case of the present invention. Therefore, the recording medium of the present invention exhibits a value of the contact angle after a slight lapse of time, such as 0.5 ms, from such landing, of much less than 10°.

In the present invention, the peak area ratio (C1s/Si2p) and the contact angle can be simultaneously adjusted to thereby allow the pigment ink to be uniformly fixed onto the surface of much of the amorphous silica, and allow high color development property in pigment ink printing to be exhibited.

In the present invention, the ink receiving layer can include two or more layers. Among such two or more ink receiving layers, an ink receiving layer farthest away from the substrate is hereinafter referred to as "ink receiving layer A". An ink receiving layer adjacent to the ink receiving layer A is hereinafter referred to as "ink receiving layer B". The mass ratio (mass of amorphous silica/mass of binder: P/B) of the amorphous silica to the binder in the ink receiving layer A can be lower than the mass ratio (P/B) of the amorphous silica to the binder in the ink receiving layer B. When the ink receiving layer A is formed on the ink receiving layer B, an water-soluble component in a coating liquid for formation of the ink receiving layer A, such as a binder, may be partially absorbed in the ink receiving layer B during coating with the ink receiving layer A. Therefore, the coating liquid for the ink receiving layer A can include a relatively large amount of the binder. As a result, minute cracks can be hardly generated after coating with the ink receiving layer A, resulting in an enhancement in color development at a higher level in printing by use of the pigment ink.

In the present invention, the ink receiving layer can also contain a nonionic surfactant in order to adjust the contact angle to a low value, and the nonionic surfactant preferably has an HLB value of 8.0 or less, more preferably 7.7 or less. A surfactant having an HLB value of 8.0 or less can be used to thereby allow the contact angle to be effectively decreased.

Hereinafter, the materials for use in the recording medium of the present invention are described in more detail.

<Substrate>

As the substrate for use in the present invention, paper such as cast-coated paper, baryta paper and resin coated paper (paper coated with a resin, both surfaces of the paper being coated with a resin such as polyolefin) can be used. A transparent thermoplastic film of polyethylene, polypropylene, polyester, polylactate, polystyrene, polyacetate, polyvinyl chloride, cellulose acetate, polyethylene terephthalate, polymethyl methacrylate, polycarbonate or the like can also be used.

Besides the above, unsized paper or coated paper subjected to proper sizing, or a sheet-shaped substance (synthetic paper or the like) opacified by packing of an inorganic substance or by fine foaming can be used. A sheet formed from glass, a metal or the like may also be used. Furthermore, the surface of the substrate can also be subjected to a corona discharge treatment or various undercoating treatments in order that the adhesion strength between such a substrate and a porous ink receiving layer is enhanced.

As the substrate, a substrate having air-permeability, such as paper subjected to proper sizing, can be used. Such a substrate can be used to thereby allow matted feeling to be realized.

<Ink Receiving Layer>

The ink receiving layer for use in the present invention contains amorphous silica and a binder. In the present invention, each ink receiving layer can be formed by preparing a coating liquid including the materials to be included in the ink receiving layer, coating the substrate with such a coating liquid, and drying the resultant. That is, in the present invention, the materials included in the ink receiving layer can be the same as the materials included in the coating liquid used for formation of the ink receiving layer.

In the present invention, the mass ratio P/B of the amorphous silica to the binder in the ink receiving layer, and the thickness of the ink receiving layer each differ between the case where the ink receiving layer includes one layer and the case where the ink receiving layer includes two or more layers.

In the present invention, when the ink receiving layer includes one layer, the mass ratio P/B of the amorphous silica to the binder is preferably 100/30 to 100/80, further preferably 100/35 to 100/60, in terms of adjustment of the peak area ratio (C1s/Si2p), adjustment of the contact angle and also strength and ink absorption property of the receiving layer. In addition, the thickness of the ink receiving layer can be 10 μm or more and 45 μm or less in terms of strength and ink absorption property of the receiving layer.

On the other hand, in the present invention, when the ink receiving layer includes two or more layers, the mass ratio P/B of the amorphous silica to the binder in the ink receiving layer A is preferably 100/35 to 100/85, further preferably 100/50 to 100/80, and the mass ratio P/B of the amorphous silica to the binder in the ink receiving layer B is preferably 100/15 to 100/40, further preferably 100/20 to 100/35, in terms of adjustment of the peak area ratio (C1s/Si2p), adjustment of the contact angle and also strengths and ink absorption properties of the receiving layers. In addition, the thickness of the ink receiving layer A can be 8 μm or more and 20 μm or less and the thickness of the ink receiving layer B can be 20 μm or more and 30 μm or less in terms of adjustment of the peak area ratio (C1s/Si2p), adjustment of the contact angle and also strengths and ink absorption properties of the receiving layers.

(Amorphous Silica)

The ink receiving layer in the present invention contains amorphous silica. The average secondary particle size of the amorphous silica, obtained by a laser diffraction method, in the ink receiving layer can also be 3 μm or more from the viewpoint that a matted surface quality is exhibited. The amorphous silica may also be used singly or as a mixture of two or more. Any amorphous silica can be suitably used as the amorphous silica for use in the ink receiving layer, regardless of the production method. Specifically, examples of the method for producing the amorphous silica include a dry method and a wet method, and amorphous silica obtained by any of the dry method and the wet method can also be suitably used in the present invention. Hereinafter, the dry method and the wet method are described in more detail. The dry method is further classified into a combustion method and a heating method, and the wet method is further classified into a precipitation method and a gelation method. The dry combustion method is a method also called gas phase method, and is a method in which a mixture gasified of silicon tetrachloride and hydrogen is combusted in air at 1500 to 2000° C. to thereby provide amorphous silica. The wet precipitation method is a method in which silicate soda is allowed to react with sulfuric acid or the like in an aqueous solution to thereby provide amorphous silica as a precipitate, and the primary particle size and the like of the silica can be adjusted depending on conditions such as the reaction temperature and the rate of addition of the acid. In addition, the secondary particle size and the like can also be changed depending on drying and pulverizing conditions. The wet gelation method is a method in which silicate soda and sulfuric acid are simultaneously added to thereby provide amorphous silica, and such a method can be used to thereby provide amorphous silica having a three-dimensional hydrogel structure, in which polymerization of a silica particle progresses by dehydration condensation of a silanol group. The silica produced by the wet gelation method has a relatively small hydrogel structure, and a secondary particle having a relatively larger specific surface area than that produced by the wet precipitation method can be produced. In the present invention, the amorphous silica obtained by the wet gelation method can be particularly adopted.

The amorphous silica for use in the present invention is not particularly limited, and the amount of oil absorption thereof, measured according to JIS-K 6217-4, is preferably 150 ml/100 g or more, and 350 ml/100 g or less, more preferably 180 ml/100 g or more, and 330 ml/100 g or less.

The amorphous silica for use in the present invention is not particularly limited, and the pore volume obtained by a BET method is preferably 1.0 ml/g or more, further preferably 1.3 ml/g or more. In addition, the specific surface area obtained by a BET method can be 200 $m^2/g$ or more and 500 $m^2/g$ or less.

In the present invention, an inorganic pigment other than the amorphous silica can also be used together with the amorphous silica as long as the effect of the present invention is not impaired. Examples of such an inorganic pigment can include white inorganic pigments such as alumina, hydrated alumina, colloidal Silica and light calcium carbonate.

(Binder)

The ink receiving layer in the present invention includes a binder. Examples of the binder include polyvinyl alcohol (PVA), oxidized starch, etherified starch, phosphoric esterified starch, carboxymethyl cellulose, hydroxyethyl cellulose, casein, gelatin, soybean protein, polyvinylpyrrolidone, a maleic anhydride resin, conjugated polymer latexes such as a styrene-butadiene copolymer and a methyl methacrylate-butadiene copolymer, acrylic polymer latexes such as acrylate and methacrylate polymers, vinyl polymer latexes such as an ethylene-vinyl acetate copolymer, a melamine resin, a urea resin, polymer or copolymer resins of acrylates and methacrylates such as polymethyl methacrylate, a polyurethane resin, an unsaturated polyester resin, a vinyl chloride-vinyl acetate copolymer, polyvinyl butyral, and an alkyd resin.

The binder can be used singly or as a mixture of a plurality thereof. In particular, a binder most preferably used is PVA. As such PVA, common PVA obtained by hydrolysis of polyvinyl acetate can be suitably used. The average degree of polymerization of PVA can be 1500 or more and 5000 or less. In addition, the degree of saponification of PVA can be 70 or more and 100 or less. Besides PVA described above, modified PVA such as silanol-modified PVA having a silanol group at the end thereof may also be used. Such PVA may be used singly or in combinations of two or more.

(Surfactant)

The ink receiving layer in the present invention can contain a surfactant, and, in particular, preferably contains a nonionic surfactant having an HLB value of 8.0 or less, more preferably contains a nonionic surfactant having an HLB value of 7.7 or less. In addition, when the ink receiving layer includes two or more layers, at least the ink receiving layer A preferably contains a nonionic surfactant having an HLB value of 8.0 or less, more preferably contains a nonionic surfactant having an HLB value of 7.7 or less.

As the nonionic surfactant, any of ether type and ester type nonionic surfactants can be used as long as such a nonionic surfactant satisfies the HLB value. For example, any commercial product can be selected from various series such as "Surfynol" (trademark of Air Products and Chemicals, Inc.), "Emanon" (trademark of Kao Corporation) and "Noigen" (trademark of DKS Co., Ltd.).

(Additive)

A pigment dispersant, a toughness improving agent or the like can be appropriately used as an additive for the coating liquid for each ink receiving layer. A cationic polymer can be added as the additive for the coating liquid in terms of high concentration dispersibility of the coating liquid, and toughness and water resistance of an image. Examples of the cationic polymer include a polymer having any primary to tertiary amine in the molecule, and a polymer having a quaternary ammonium salt. Specifically, examples include polyalkylenepolyamines or derivatives thereof, a dicyan-based cation resin, a polyamine-based cation resin, an epichlorohydrin-dimethylamine addition polymer, a dimethyldiallylammonium chloride polymer and a diallylamine salt polymer. The content of the additive can be 0.1% by mass or more and 30% by mass or less based on 100% by mass of the amorphous silica.

<Method for Producing Recording Medium>

The method for producing the recording medium of the present invention is not particularly limited, and the recording medium can be produced by the following method. First, an ink receiving layer coating liquid including amorphous silica and a binder is prepared. Next, an air-permeable substrate is coated with the ink receiving layer coating liquid prepared, and the resultant is dried to thereby provide an ink receiving layer.

In the present invention, the coating and drying methods of the ink receiving layer coating liquid are not particularly limited, and any methods can be suitably used. Specifically, any of on-machine and off-machine methods can be used in coating with the ink receiving layer coating liquid. As a coating machine, any of coating machines such as various curtain coaters, a coater using an extrusion system, and a coater using a slide hopper system can be suitably used. In coating with the ink receiving layer coating liquid, the coating liquid may also be warmed and a coater head may also be warmed for the purpose of adjustment of the viscosity of the coating liquid, and the like. A hot air dryer such as a linear tunnel dryer, an arch dryer, an air loop dryer or a sine curve air float dryer can be suitably used for drying of the coating liquid after coating. An infrared heating dryer, a dryer utilizing microwaves, or the like can be appropriately selected for use.

One aspect of the present invention can provide a recording medium having a matted surface quality, which enables the optical density of an image at a high level to be achieved in printing by use of an aqueous pigment ink.

EXAMPLES

Hereinafter, the present invention is more specifically described with reference to Examples. Herein, the following Examples are specific examples shown for deeper understanding of the present invention, and the present invention is not limited to such Examples at all.

<Production of Substrate>

An air-permeable substrate was produced in the following conditions. First, a paper stock having the following composition was prepared by water so that the solid concentration was 3.0% by mass.

(Paper Stock)

| | |
|---|---|
| Broad-leaved tree bleached kraft pulp (LBKP) having a freeness of 450 ml CSF | 80 parts by mass |
| Needle-leaved tree bleached kraft pulp (NBKP) having a freeness of 480 ml CSF | 20 parts by mass |
| Cationized starch | 0.60 parts by mass |
| Heavy calcium carbonate | 10 parts by mass |
| Light calcium carbonate | 15 parts by mass |
| Alkyl ketene dimer | 0.10 parts by mass |
| Cationic polyacrylamide | 0.030 parts by mass |

In the composition of the paper stock, CSF is an abbreviation of Canadian Standard Freeness.

Next, water including the paper stock in a solid concentration of 3% by mass was subjected to papermaking by a Fourdrinier machine and three-step wet pressing, and thereafter dried by a multicylinder dryer. Thereafter, the resultant was impregnated with an aqueous oxidized starch solution by a size press apparatus so that the solid content was 1.0 g/m$^2$, and dried. Thereafter, machine-calendar finishing was performed to thereby provide an air-permeable substrate having a basis weight of 230 g/m$^2$, a thickness of 300 μm, a Stockigt sizing degree of 100 seconds, an air permeability of 50 seconds and a Bekk smoothness of 15 seconds.

<Production of Inkjet Recording Medium>

(Preparation of Dispersion Liquids A, B, C and D)

Amorphous silica A (trade name: Nipgel AY-603 (produced by Tosoh Silica Corporation), average secondary particle size: 10 μm) was added into a solution, in which 10 parts by mass of Sharol DC-902 (trade name, produced by DKS Co., Ltd.) based on 100 parts by mass of silica was added into pure water, so that the solid concentration of amorphous silica A was 19% by mass, and sufficiently stirred by a stirrer to provide a dispersion liquid. The resulting dispersion liquid was appropriately diluted with pure water so that the solid concentration of the amorphous silica was 18% by mass, thereby providing dispersion liquid A in which the amorphous silica was dispersed.

The same operation as in preparation of dispersion liquid A was performed except that amorphous silica A was changed to amorphous silica B (trade name: Gasil HP39 (produced by PQ Corporation), average secondary particle size: 10 μm), amorphous silica C (trade name: Gasil 23F (produced by PQ Corporation), average secondary particle size: 6 μm) and amorphous silica D (trade name: Mizukasil P78D (produced by Mizusawa Industrial Chemicals Ltd.), average secondary particle size: 12 μm), thereby providing dispersion liquids B, C and D, in which the solid concentration of each amorphous silica was 18% by mass, respectively. The average secondary particle size of each amorphous silica was the value measured by a laser diffraction method.

(Preparation of Ink Receiving Layer Coating Liquids a, B and C)

Binder A (PVA235 (polyvinyl alcohol): produced by Kuraray Co., Ltd.) was dissolved in ion-exchange water to thereby provide aqueous PVA solution A having a solid content of 8.0% by mass. Similarly, binder B (PVA117 (polyvinyl alcohol): produced by Kuraray Co., Ltd.) and binder C (R1130 (silanol-modified polyvinyl alcohol): produced by Kuraray Co., Ltd.) were each dissolved in ion-exchange water to thereby provide aqueous PVA solution B having a solid content of 10.0% by mass and aqueous PVA solution C having a solid content of 8.0% by mass, respectively. Thereafter, PVA solution A obtained was added to dispersion liquid A obtained by the above operation so that the mass ratio, amorphous silica:binder A (PVA), with respect to the solid of amorphous silica was 100:40. The resulting mixed liquid was diluted with pure water so that the total solid concentration of the mixed liquid was 13% by mass, and 0.1% by mass of a surfactant (Surfynol 420: produced by Air Products and Chemicals, Inc.; HLB value: 4.0) was further added to the diluted liquid, and stirred to thereby provide ink receiving layer coating liquid A. In addition, PVA solution A obtained was added to dispersion liquid A obtained by the above operation so that the mass ratio, amorphous silica:binder A (PVA), was 100:25. The resulting mixed liquid was diluted with pure water so that the total solid concentration of the mixed liquid was 13% by mass, and a 0.1% by mass of a surfactant (Surfynol 420: produced by Air Products and Chemicals, Inc.; HLB value: 4.0) was further added to the diluted liquid, and stirred to thereby provide ink receiving layer coating liquid B. In addition, PVA solution B and PVA solution C obtained were added to dispersion liquid A obtained by the above operation so that the mass ratio, amorphous silica:binder B (PVA): binder C (PVA), was 100:35:35. The resulting mixed liquid was diluted with pure water so that the total solid concentration of the mixed liquid was 13% by mass, and 0.1% by mass of a surfactant (Surfynol 420: produced by Air Products and Chemicals, Inc.; HLB value: 4.0) was further added to the diluted liquid, and stirred to thereby provide ink receiving layer coating liquid C.

(Preparation of Ink Receiving Layer Coating Liquid D)

Amorphous silica A was added into a solution, in which 0.5 parts by mass of sodium polyacrylate (Aron A9: produced by Toagosei Co., Ltd.) based on 100 parts by mass of silica was added into pure water, so that the solid concentration of amorphous silica A was 19% by mass. The resulting mixture was sufficiently stirred by a stirrer to provide a dispersion liquid. The resulting dispersion liquid was appropriately diluted with pure water so that the solid concentration of the amorphous silica was 18% by mass, thereby providing dispersion liquid E.

Next, binder C, an acrylic resin (Primal P-376: produced by Roam and Haas Company) and a cation polymer (Neofix IJ-117: produced by Nicca Chemical Co., Ltd.) were added to dispersion liquid E obtained so that the mass ratio, amorphous silica A:binder C:acrylic resin:cation polymer, was 100:20:20:20. Furthermore, 10 parts of a surfactant (Noigen ET-83: produced by DKS Co., Ltd.; HLB value: 6.4) based on 100 parts of the amorphous silica was added to the resulting mixed liquid. Thereafter, the resulting mixed liquid was appropriately diluted with pure water so that the total solid concentration of the mixed liquid was 13% by mass, and stirred to thereby provide ink receiving layer coating liquid D.

(Preparation of Ink Receiving Layer Coating Liquid E)

Amorphous silica A and amorphous silica E (trade name: Mizukasil P-50 (produced by Mizusawa Industrial Chemicals Ltd.), average secondary particle size: 7 μm) were added into pure water so that the solid concentration of amorphous silica A was 14% by mass and the solid concentration of amorphous silica E was 6% by mass, thereby providing dispersion liquid F.

Next, binder B, an ethylene vinyl acetate copolymer latex (Rikabond BE-7000: Produced by Chirika Co., Ltd.) and a cation polymer (Polymaron 360: produced by Arakawa Chemical Industries, Ltd.) were added to dispersion liquid F obtained so that the mass ratio, amorphous silica A:amorphous silica E:binder C:ethylene vinyl acetate copolymer: cation polymer, was 70:30:35:25:2. Thereafter, the resulting mixed liquid was appropriately diluted with pure water so that the total solid concentration of the mixed liquid was 18% by mass, and stirred to thereby provide ink receiving layer coating liquid E.

(Production of Inkjet Recording Media 1 to 32)

Each of inkjet recording media 1 to 32 was produced as described below. Herein, the materials and production conditions for use in production of each of inkjet recording media 1 to 32 are shown in Tables 1 and 2 below.

TABLE 1

| | Ink receiving layer A | | | Ink receiving layer B | | | Surfactant | | Drying |
|---|---|---|---|---|---|---|---|---|---|
| | Amorphous silica | Binder | P/B | Amorphous silica | Binder | P/B | Type | HLB value | temperature (° C.) |
| Example 1 | AY-603 | PVA235 | 100/40 | — | — | — | SF420 | 4.0 | 90 |
| Example 2 | AY-603 | PVA235 | 100/40 | — | — | — | SF420 | 4.0 | 120 |
| Example 3 | AY-603 | PVA235 | 100/60 | — | — | — | SF420 | 4.0 | 90 |
| Example 4 | AY-603 | PVA235 | 100/40 | — | — | — | SF440 | 8.0 | 90 |
| Example 5 | AY-603 | PVA235 | 100/70 | — | — | — | SF420 | 4.0 | 90 |
| Example 6 | AY-603 | PVA235 | 100/80 | — | — | — | SF420 | 4.0 | 90 |
| Example 7 | AY-603 | PVA235 | 100/35 | — | — | — | SF420 | 4.0 | 90 |
| Example 8 | AY-603 | PVA235 | 100/30 | — | — | — | SF420 | 4.0 | 90 |
| Example 9 | AY-603 | PVA235 | 100/60 | AY-603 | PVA235 | 100/25 | SF420 | 4.0 | 90 |
| Example 10 | AY-603 | PVA117, R1130 | 100/35/35 | AY-603 | PVA235 | 100/25 | SF420 | 4.0 | 90 |
| Example 11 | AY-603 | PVA117, R1130 | 100/37.5/37.5 | AY-603 | PVA235 | 100/25 | SF420 | 4.0 | 90 |
| Example 12 | AY-603 | PVA117, R1130 | 100/35/35 | AY-603 | PVA235 | 100/30 | SF420 | 4.0 | 90 |
| Example 13 | AY-603 | PVA117, R1130 | 100/40/40 | AY-603 | PVA235 | 100/30 | SF420 | 4.0 | 90 |
| Example 14 | AY-603 | PVA117, R1130 | 100/41/41 | AY-603 | PVA235 | 100/30 | SF420 | 4.0 | 90 |
| Example 15 | AY-603 | PVA117, R1130 | 100/42.5/42.5 | AY-603 | PVA235 | 100/30 | SF420 | 4.0 | 90 |
| Example 16 | AY-603 | PVA117, R1130 | 100/41/41 | AY-603 | PVA235 | 100/35 | SF420 | 4.0 | 90 |
| Example 17 | AY-603 | PVA235 | 100/50 | AY-603 | PVA235 | 100/25 | SF420 | 4.0 | 90 |
| Example 18 | AY-603 | PVA235 | 100/45 | AY-603 | PVA235 | 100/25 | SF420 | 4.0 | 90 |
| Example 19 | AY-603 | PVA235 | 100/35 | AY-603 | PVA235 | 100/25 | SF420 | 4.0 | 90 |
| Example 20 | AY-603 | PVA235 | 100/60 | AY-603 | PVA235 | 100/25 | ES-99D | 7.7 | 90 |

TABLE 1-continued

| | Ink receiving layer A | | | Ink receiving layer B | | | Surfactant | | Drying |
|---|---|---|---|---|---|---|---|---|---|
| | Amorphous silica | Binder | P/B | Amorphous silica | Binder | P/B | Type | HLB value | temperature (° C.) |
| Example 21 | AY-603 | PVA235 | 100/60 | AY-603 | PVA235 | 100/25 | SF440 | 8.0 | 90 |
| Example 22 | AY-603 | PVA235 | 100/60 | AY-603 | PVA235 | 100/25 | SF465 | 13.0 | 90 |
| Example 23 | AY-603 | PVA235 | 100/60 | AY-603 | PVA235 | 100/25 | DL-0415 | 15.0 | 90 |
| Example 24 | HP39 | PVA235 | 100/60 | AY-603 | PVA235 | 100/25 | SF420 | 4.0 | 90 |
| Example 25 | 23F | PVA235 | 100/60 | AY-603 | PVA235 | 100/25 | SF420 | 4.0 | 90 |
| Example 26 | P78D | PVA235 | 100/60 | AY-603 | PVA235 | 100/25 | SF420 | 4.0 | 90 |

TABLE 2

| | Ink receiving layer A | | | Ink receiving layer B | | | Surfactant | | Drying |
|---|---|---|---|---|---|---|---|---|---|
| | Amorphous silica | Binder | P/B | Amorphous silica | Binder | P/B | Type | HLB value | temperature (° C.) |
| Comparative Example 1 | AY-603 | PVA235 | 100/40 | — | — | — | — | — | 90 |
| Comparative Example 2 | AY-603 | PVA235 | 100/82 | — | — | — | SF420 | 4.0 | 90 |
| Comparative Example 3 | AY-603 | PVA235 | 100/25 | — | — | — | SF420 | 4.0 | 90 |
| Comparative Example 4 | AY-603 | PVA117, R1130 | 100/44/44 | AY-603 | PVA235 | 100/30 | SF420 | 4.0 | 90 |
| Comparative Example 5 | AY-603 | PVA235 | 100/30 | AY-603 | PVA235 | 100/25 | SF420 | 4.0 | 90 |
| Comparative Example 6 | AY-603 | R1130, P-376 | 100/20/20 | — | — | — | ET-83 | 6.4 | 90 |
| Comparative Example 7 | AY-603, P-50 | PVA117, BE-7000 | 70/30/35/25 | — | — | — | — | — | 90 |

Example 1

The air-permeable substrate was coated with ink receiving layer coating liquid A so that the thickness after drying was 30 μm, and thereafter dried at 90° C. to thereby provide inkjet recording medium 1.

Example 2

The same operation as in Example 1 was performed except that the drying temperature was changed from 90° C. to 120° C., thereby providing inkjet recording medium 2.

Example 3

The same operation as in Example 1 was performed except that the mass ratio, amorphous silica:binder A (PVA), in ink receiving layer coating liquid A was changed to 100:60, thereby providing inkjet recording medium 3.

Example 4

The same operation as in Example 1 was performed except that the surfactant of ink receiving layer coating liquid A was changed to a surfactant (Surfynol 440: produced by Air Products and Chemicals, Inc.; HLB value: 8.0), thereby providing inkjet recording medium 4.

Example 5

The same operation as in Example 1 was performed except that the mass ratio, amorphous silica:binder A (PVA), in ink receiving layer coating liquid A was changed to 100:70, thereby providing inkjet recording medium 5.

Example 6

The same operation as in Example 1 was performed except that the mass ratio, amorphous silica:binder A (PVA), in ink receiving layer coating liquid A was changed to 100:80, thereby providing inkjet recording medium 6.

Example 7

The same operation as in Example 1 was performed except that the mass ratio, amorphous silica:binder A (PVA), in ink receiving layer coating liquid A was changed to 100:35, thereby providing inkjet recording medium 7.

Example 8

The same operation as in Example 1 was performed except that the mass ratio, amorphous silica:binder A (PVA), in ink receiving layer coating liquid A was changed to 100:30, thereby providing inkjet recording medium 8.

Example 9

The air-permeable substrate was coated with ink receiving layer coating liquid B so that the thickness after drying was 25 μm, and thereafter dried at 90° C. to thereby provide ink receiving layer B. Thereafter, ink receiving layer B was coated with a coating liquid, in which the mass ratio, amorphous silica:binder A (PVA), in ink receiving layer coating liquid A was changed to 100:60, so that the thickness after drying was 10 μm, and thereafter dried at 90° C. to thereby provide inkjet recording medium 9.

Example 10

The same operation as in Example 9 was performed except that ink receiving layer coating liquid A was changed to ink receiving layer coating liquid C, thereby providing inkjet recording medium 10.

Example 11

The same operation as in Example 10 was performed except that the mass ratio, amorphous silica:binder B (PVA): binder C (PVA), in ink receiving layer coating liquid C was changed to 100:37.5:37.5, thereby providing inkjet recording medium 11.

Example 12

The same operation as in Example 10 was performed except that the mass ratio, amorphous silica:binder A (PVA), in ink receiving layer coating liquid B was changed to 100:30, thereby providing inkjet recording medium 12.

Example 13

The same operation as in Example 12 was performed except that the mass ratio, amorphous silica:binder B (PVA): binder C (PVA), in ink receiving layer coating liquid C was changed to 100:40:40, thereby providing inkjet recording medium 13.

Example 14

The same operation as in Example 12 was performed except that the mass ratio, amorphous silica:binder B (PVA): binder C (PVA), in ink receiving layer coating liquid C was changed to 100:41:41, thereby providing inkjet recording medium 14.

Example 15

The same operation as in Example 12 was performed except that the mass ratio, amorphous silica:binder B (PVA): binder C (PVA), in ink receiving layer coating liquid C was changed to 100:42.5:42.5, thereby providing inkjet recording medium 15.

Example 16

The same operation as in Example 14 was performed except that the mass ratio, amorphous silica:binder A (PVA), in ink receiving layer coating liquid B was changed to 100:35, thereby providing inkjet recording medium 16.

Example 17

The same operation as in Example 9 was performed except that the mass ratio, amorphous silica:binder A (PVA), in ink receiving layer coating liquid A was changed to 100:50, thereby providing inkjet recording medium 17.

Example 18

The same operation as in Example 9 was performed except that the mass ratio, amorphous silica:binder A (PVA), in ink receiving layer coating liquid A was changed to 100:45, thereby providing inkjet recording medium 18.

Example 19

The same operation as in Example 9 was performed except that the mass ratio, amorphous silica:binder A (PVA), in ink receiving layer coating liquid A was changed to 100:35, thereby providing inkjet recording medium 19.

Example 20

The same operation as in Example 9 was performed except that the surfactant of ink receiving layer coating liquid A was changed to a surfactant (Noigen ES-99D: produced by DKS Co., Ltd.; HLB value: 7.7), thereby providing inkjet recording medium 20.

Example 21

The same operation as in Example 9 was performed except that the surfactant of ink receiving layer coating liquid A was changed to a surfactant (Surfynol 440: produced by Air Products and Chemicals, Inc.; HLB value: 8.0), thereby providing inkjet recording medium 21.

Example 22

The same operation as in Example 9 was performed except that the surfactant of ink receiving layer coating liquid A was changed to a surfactant (Surfynol 465: produced by Air Products and Chemicals, Inc.; HLB value: 13.0), thereby providing inkjet recording medium 22.

Example 23

The same operation as in Example 9 was performed except that the surfactant of ink receiving layer coating liquid A was changed to a surfactant (Noigen DL-0415: produced by DKS Co., Ltd.; HLB value: 15.0), thereby providing inkjet recording medium 23.

Example 24

The same operation as in Example 9 was performed except that dispersion liquid A used for preparation of ink receiving layer coating liquid A was changed to dispersion liquid B, thereby providing inkjet recording medium 24.

Example 25

The same operation as in Example 9 was performed except that dispersion liquid A used for preparation of ink receiving layer coating liquid A was changed to dispersion liquid C, thereby providing inkjet recording medium 25.

Example 26

The same operation as in Example 9 was performed except that dispersion liquid A used for preparation of ink receiving layer coating liquid A was changed to dispersion liquid D, thereby providing inkjet recording medium 26.

Comparative Example 1

The same operation as in Example 1 was performed except that the surfactant of ink receiving layer coating liquid A was not added, thereby providing inkjet recording medium 27.

Comparative Example 2

The same operation as in Example 1 was performed except that the mass ratio, amorphous silica:binder A (PVA), in ink receiving layer coating liquid A was changed to 100:82, thereby providing inkjet recording medium 28.

Comparative Example 3

The same operation as in Example 1 was performed except that the mass ratio, amorphous silica:binder A (PVA), in ink receiving layer coating liquid A was changed to 100:25, thereby providing inkjet recording medium 29.

Comparative Example 4

The same operation as in Example 12 was performed except that the mass ratio, amorphous silica:binder B (PVA): binder C (PVA), in ink receiving layer coating liquid C was changed to 100:44:44, thereby providing inkjet recording medium 30.

Comparative Example 5

The same operation as in Example 9 was performed except that the mass ratio, amorphous silica:binder A (PVA), in ink receiving layer coating liquid A was changed to 100:30, thereby providing inkjet recording medium 31.

Comparative Example 6

The same operation as in Example 1 was performed except that ink receiving layer coating liquid A was changed to ink receiving layer coating liquid D, thereby providing inkjet recording medium 32.

Comparative Example 7

The same operation as in Example 1 was performed except that ink receiving layer coating liquid A was changed to ink receiving layer coating liquid E, thereby providing inkjet recording medium 33.

<Evaluation of Recording Medium>

(Calculation of Peak Area Ratio)

The peaks of a carbon is electron (C1s) and a silicon 2p electron (Si2p) were observed in measurement by an XPS apparatus "QUANTUM 2000" (trade name, manufactured by ULVAC-PHI Inc.). Specifically, the surface of each of the recording media obtained by the above operation was subjected to measurement in a scanning area (Scan Size) of 1 mm×1 mm under conditions of the X-ray source, of an acceleration voltage of 15 kV, an emission current of 3 mA and a degree of vacuum of $1.2\times10^{-8}$ mbar. The respective areas of the resulting peaks of a carbon is electron and a silicon 2p electron were determined by a half value method, and the peak area ratio (C1s/Si2p) was calculated. The measurement results are shown in Table 3.

(Measurement of Contact Angle Value)

The contact angle value was measured as follows. 4 μl of pure water was dropped on the surface of the ink receiving layer in an environment of 23° C. and 50% RH by use of a dynamic absorption tester (DAT) 1100 manufactured by Fibro Systems AB. After such dropping, the contact angle after a lapse of 10 ms was then measured. The measurement results are shown in Table 3.

(Evaluation of Optical Density of Image)

A printer (trade name: "PIXUS Pro-1", manufactured by Canon Inc.) using an inkjet system was used to print a solid patch (Duty of black: 100%) on each of inkjet recording media 1 to 32 in a fine art "Photo Paper Premium Matte" mode. Herein, a black ink of "PGI-39" (trade name, manufactured by Canon Inc.) being an ink tank of the printer was used as the pigment ink. Thereafter, the resultant was kept in an environment of 25° C. and 50% R.H. (relative humidity) for 2 days, the region on which the solid patch was printed was then subjected to color measurement by use of a spectrophotometer "Spectrolino" (trade name, manufactured by GretagMacbeth AG), and the O.D. value (optical density) of each of the inkjet recording media was thus calculated. The resulting O.D. value and the following evaluation criteria were used to evaluate the optical density of the image obtained in printing by use of the pigment ink. The evaluation results are shown in Table 3.

A: The O.D. value was 1.73 or more.

B: The O.D. value was 1.69 or more and less than 1.73.

C: The O.D. value was 1.65 or more and less than 1.69.

D: The O.D. value was less than 1.65.

TABLE 3

| | Recording medium | C1s/Si2p | Contact angle after 10 ms (°) | Optical density of image |
|---|---|---|---|---|
| Example 1 | Recording medium 1 | 1.2 | 40 | A |
| Example 2 | Recording medium 2 | 1.7 | 43 | A |
| Example 3 | Recording medium 3 | 1.7 | 43 | A |
| Example 4 | Recording medium 4 | 1.2 | 45 | A |
| Example 5 | Recording medium 5 | 2.0 | 50 | B |
| Example 6 | Recording medium 6 | 2.3 | 55 | C |
| Example 7 | Recording medium 7 | 1.0 | 39 | A |
| Example 8 | Recording medium 8 | 0.7 | 38 | C |
| Example 9 | Recording medium 9 | 1.3 | 48 | A |
| Example 10 | Recording medium 10 | 1.7 | 52 | A |
| Example 11 | Recording medium 11 | 1.8 | 53 | B |
| Example 12 | Recording medium 12 | 1.8 | 52 | B |
| Example 13 | Recording medium 13 | 2.0 | 56 | B |
| Example 14 | Recording medium 14 | 2.1 | 58 | C |
| Example 15 | Recording medium 15 | 2.3 | 60 | C |
| Example 16 | Recording medium 16 | 2.3 | 58 | C |
| Example 17 | Recording medium 17 | 1.0 | 45 | A |
| Example 18 | Recording medium 18 | 0.9 | 43 | B |
| Example 19 | Recording medium 19 | 0.7 | 40 | B |
| Example 20 | Recording medium 20 | 1.3 | 50 | A |
| Example 21 | Recording medium 21 | 1.3 | 52 | A |
| Example 22 | Recording medium 22 | 1.3 | 53 | B |
| Example 23 | Recording medium 23 | 1.3 | 60 | B |
| Example 24 | Recording medium 24 | 1.3 | 48 | A |
| Example 25 | Recording medium 25 | 1.3 | 48 | A |
| Example 26 | Recording medium 26 | 1.3 | 48 | A |
| Comparative Example 1 | Recording medium 27 | 1.5 | 75 | D |
| Comparative Example 2 | Recording medium 28 | 2.4 | 58 | D |
| Comparative Example 3 | Recording medium 29 | 0.6 | 37 | D |
| Comparative Example 4 | Recording medium 30 | 2.4 | 62 | D |
| Comparative Example 5 | Recording medium 31 | 0.6 | 38 | D |
| Comparative Example 6 | Recording medium 32 | 1.6 | 81 | D |
| Comparative Example 7 | Recording medium 33 | 1.8 | 80 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002756, filed Jan. 8, 2016, which is hereby incorporated by reference herein in its entirety.

What is claimed is:

1. An inkjet recording medium comprising:

a substrate; and an ink receiving layer on the substrate, wherein the ink receiving layer comprises amorphous silica having an average secondary particle size of 3 μm or more, and a binder, wherein a peak area ratio (C1s/Si2p) of a carbon atom (C1s) to a silicon atom (Si2p) in measurement of a surface of the ink receiving layer by X-ray photoelectron spectroscopy is 0.7 or more and 2.3 or less, and wherein a contact angle between the surface of the ink receiving layer and pure water after a lapse of 10 ms from contact of the surface of the ink receiving layer with 4 μl of pure water is 38° or more and 60° or less.

2. The inkjet recording medium according to claim 1, wherein the peak area ratio (C1s/Si2p) is 0.7 or more and 2.0 or less.

3. The inkjet recording medium according to claim 1, wherein the peak area ratio (C1s/Si2p) is 1.0 or more and 1.7 or less.

4. The inkjet recording medium according to claim 1, wherein the contact angle is 52° or less.

5. The inkjet recording medium according to claim 1, wherein the ink receiving layer comprises two or more layers.

6. The inkjet recording medium according to claim 1, wherein the ink receiving layer comprises a nonionic surfactant having an HLB value of 8.0 or less.

7. The inkjet recording medium according to claim 1, wherein the binder contains polyvinyl alcohol.

* * * * *